US005762074A

United States Patent [19]

Garner

[11] Patent Number: 5,762,074

[45] Date of Patent: Jun. 9, 1998

[54] TOBACCO SHEETS FOR ROLLING TOBACCO PRODUCTS

[76] Inventor: Robby D. Garner, 11601 Cosca Park Dr., Clinton, Md. 20735

[21] Appl. No.: 768,435

[22] Filed: Dec. 18, 1996

Related U.S. Application Data

[60] Provisional application No. 60/010,540, Dec. 23, 1997.

[51] Int. Cl.[6] ..... A24D 1/00

[52] U.S. Cl. ..... 131/360; 131/353; 131/358

[58] Field of Search ..... 224/5 C, 252; 131/329, 256, 358, 257, 360, 353, 175, 332

[56] References Cited

U.S. PATENT DOCUMENTS 3,385,302 5/1968 Wattenford ..... 131/360

5,632,287 5/1997 Hayworth ..... 131/360

*Primary Examiner*—Aaron J. Lewis
*Assistant Examiner*—Charles W. Anderson
*Attorney, Agent, or Firm*—Richard C. Litman

[57] ABSTRACT

Reconstituted tobacco sheets prepared and packaged such that a consumer may roll a smokable tobacco product from a single sheet of reconstituted tobacco. The preferred embodiment comprises a plurality of rectangular sheets of reconstituted tobacco, each sheet precut to a predetermined rectangular dimension of standardized width and length so that the sheets, when rolled, conform to the various standard lengths and sizes of commercially available tobacco products. Each sheet is provided with a gummed edge for sealing of a rolled tobacco product. A plurality of sheets may be stacked and bound along one side to each other to form a pad of sheets for convenient commercial packaging and sale to the consumer.

8 Claims, 3 Drawing Sheets

TOBACCO SHEETS FOR ROLLING TOBACCO PRODUCTS

CROSS-REFERENCE TO RELATED APPLICATIONS

This application claims the benefit of U.S. Provisional application Ser. No. 60/010,540, filed Jan. 24, 1996. Now application Ser. No. 08/768,435 issued on Dec. 23, 1997.

BACKGROUND OF THE INVENTION

1. Field of the Invention

The present invention relates to reconstituted tobacco sheets prepared and packaged such that a consumer may roll a smokable tobacco product from a single sheet of reconstituted tobacco.

2. Description of the Prior Art

Rolling papers specifically made for tobacco smoking have been known in the prior art since at least as early as the 19th century These papers were, and still are, used to wrap shredded-leaf or processed tobacco into cigarettes. Although the smoke of the rolling paper is inhaled as part of the combustion of the cigarette, none of the rolling paper products known in the prior art as "roll-your-own" cigarette papers are made of tobacco sheet material which can be conveniently packaged for distribution and use desired to be smoked to be conveniently be rolled from a single sheet of rolling paper without added elements.

For example, U.S. Pat. No. 238,966 issued to Randolph describes a cigarette-paper package, including a case containing sheets of cigarette-paper, each of which is gummed on one face along one of its longer edges, so that, after the cigarette is rolled on this edge and moistened, the edge can adhere to the body of the cigarette. However, the patent fails to disclose the use of tobacco as cigarette paper, and, apparently shows the cigarette paper illustrated in FIG. 3 intended for use with shredded-leaf tobacco only.

Reconsitituted tobacco wrappers for use in preparing tobacco products such as cigarettes and cigars are equally well known. For example, U.S. Pat. No. 914,394 issued Mar. 9, 1909 to Diskin describes a use of tobacco stems and clippings for production of tobacco paper. Diskin suggests that the object in making paper of tobacco is "for the purpose of replacing the paper now generally used for cigarettes with a paper made of real tobacco and thereby avoid all injurious and harmful effects now common, due to the inhaling of the smoke from ordinary paper." U.S. Pat. No. 92,427 issued Jul. 13, 1969 issued to Consuegra and Antiguedad describe an improved method of manufacturing a wrapper of cigarette paper made entirely of tobacco. The method discloses that a boiled pulp, to which flavors or other additives can be added, may be made to produce a tobacco paper. U.S. Pat. No. 5,322,076 issued Jun. 21, 1994 to Brinkley et al. describes a wet-formed process for providing reconstituted tobacco-containing paper for cigarettes. Suggested uses of the paper include using it as a substrate for flavors, as a smokable filler, as a wrapper for tobacco rods and as a component for filter elements.

Although many uses have been suggested for reconstituted tobacco, none of the above-mentioned patents suggests a structure which employs tobacco paper as a gummed cigarette-paper for convenient marketing and consumer use as either the entire replacement for shredded-leaf contents to be smoked or for wrapping of shredded-leaf contents. The advantages over premanufactured cigarettes and cigars derive from the preparation of a tobacco sheet stack according to the present invention, which include the advantage to the manufacturer of minimizing the cost of freshness-sensitive packaging (simpler wrapping processes), and the advantage to the consumer of having an improved crush-resistance characteristic over cigarette cartons or packs. Numerous other cost and convenience advantages can be appreciated from the simplicity of a conveniently packaged stack of individual tobacco cigarette papers.

Other methods of producing reconstituted tobacco wrappers can be found in the prior art, but none suggest adding a gummed strip to improve the packaging of such a paper as a product for consumer convenience and consumption as a final product. U.S. Pat. No. 430,516 issued Jun. 17, 1980 to Endemann describes a process of preparing paper-pulp from tobacco using predominantly stems and tobacco waste and sulphate of alumina. U.S. Pat. No. 4,542,755 issued Sep. 24, 1985 to Selke et al. describes a method of producing reconstituted tobacco by a dry-forming process in which tobacco fiber is gas-laid onto a foraminous web. U.S. Pat. No. 4,452,257 issued Jun. 5, 1984 to Cartwright et al. describes a treatment system for treatment of a natural leaf tobacco wrapper using a humectant/plasticizer film-forming component.

None of the above inventions and patents, taken either singly or in combination, is seen to describe the instant invention as claimed.

SUMMARY OF THE INVENTION

The present invention relates to reconstituted tobacco sheets prepared and packaged such that a consumer may roll a final smokable tobacco product from a single sheet of reconstituted tobacco. The preferred embodiment comprises a plurality of rectangular-sheets of reconstituted tobacco, each sheet precut to a predetermined rectangular dimension of standardized width and length, preferably so that the sheets, when rolled, conform to the various standard lengths of tobacco products. The term "tobacco products" as used herein is defined throughout to include any of the commercially sold tobacco products which are smoked, but not chewed, such as cigarettes and cigars, which generally have a cylindrical-rod shape. Such tobacco products are usually produced in various standardized lengths, e.g. "100s".

Each standardized reconstituted tobacco sheet is cut so that it has a pair of long edges and a pair of wide edges. Each such sheet is provided with a gum applied to one of the edges, so that such edge can be secured to the outer surface of a sheet which has been rolled into a tobacco rod configuration for smoking. Each sheet is suited for preparation by a consumer into a final tobacco product by manually rolling the sheet along an axis parallel with one side and sealing the rolled sheet by the gummed edge, thus creating a final tobacco product which may then be subsequently smoked. This "one-step" rolling eliminates the need for non-tobacco rolling papers and loose cut-leaf tobacco. In addition, reconstituted tobacco sheets having a smoking aroma and characteristic of cigar tobacco may be used, so that the product can afford cigar aficionados the taste and aroma of cigars in the convenience of a cigarette. Moreover, if the consumer desires, such sheet may be used for wrapping conventional cut-leaf tobacco.

For greatest convenience, a plurality of such sheets can be stacked in a predetermined number and packaged, either by the loose sheet or as a bound pad. The bound pad is formed by applying a tearable adhesive to one side of the stack, thereby binding each of the plurality of sheets into a bound stack of individually removable sheets (most analogous to the currently popular 3M® Post-it™ office paper note pads). In the alternative, the tobacco sheet product may simply be packaged as loose sheets in a container or wrapping. Either of these approaches minimizes the packaging necessary for both storage and shipping of the product. The packaging provides a further advantage to the consumer by eliminating the need for "crush-proof" boxes; a stack of tobacco sheets is flexible, yet crush resistant, thereby allowing a consumer to easily slip the package into any pocket. Moreover, it allows the consumer to carry a larger volume of tobacco, reducing the consumer's worry of finding himself without a smoke.

For the manufacturer, the sheet stack packaging of the present invention eliminates the costs of producing a cigarette and packaging it to avoid crushing or breakage. Moreover, the sheet stack allows packaging to be very environmentally friendly whereby less packaging waste may be produced. The present invention also simplifies packaging for purposes of maintaining freshness of the tobacco sheets.

Accordingly, it is a principal object of the invention to provide a standardized package of reconstituted tobacco sheets for manually rolling into a smokable tobacco product.

It is another object of the invention to provide a reconstituted tobacco sheet of predetermined dimensions having a gummed edge for sealing the edge upon rolling of the sheet.

It is a further object of the invention to provide a tobacco standardized reconstituted tobacco sheet for ease of packaging.

Still another object of the invention is to provide a tobacco sheet product of reconstituted tobacco sheets bound into a stack having singly removable sheets.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
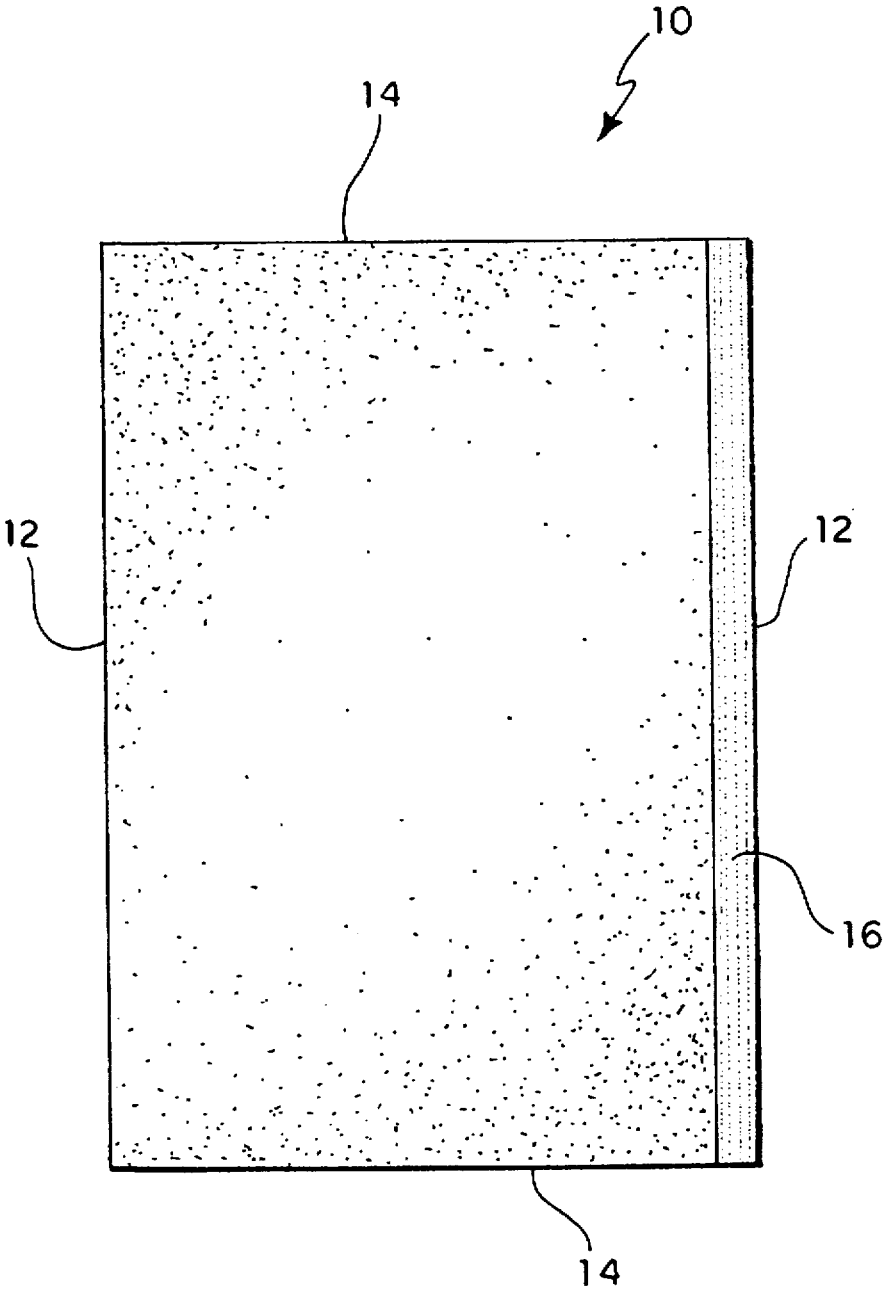
FIG. 1 is a top view of a gummed reconstituted tobacco sheet

The present invention relates to reconstituted tobacco sheets prepared and packaged such that a consumer may roll a tobacco product from a single sheet of reconstituted tobacco. FIG. 1 shows a sheet of reconstituted tobacco 10 comprising the preferred embodiment. Each sheet 10 is precut to a predetermined rectangular dimension of a standardized width and length so that the sheets conform to the various standard lengths of tobacco products, such as 84 mm (regulars) and 100 mm (100s). Each sheet is cut so that it has a pair of long edges 12 and a pair of wide edges 14. In the preferred embodiment, a gum 16 is applied along a long edge 12, shown as a strip. A suitable gum as found in the prior art which can be safely inhaled when smoked and having suitable adhesive properties may be chosen. Reconstituted tobacco sheets having the smoking aroma and characteristic of cigar tobacco, or any other desired qualities, may also be used to provide a preferred taste and aroma. A suitable reconstituted tobacco sheet for use in the present invention is the cigar tobacco wrapping presently and commonly used to form the outer wrap of a cigar.

Figure 2:
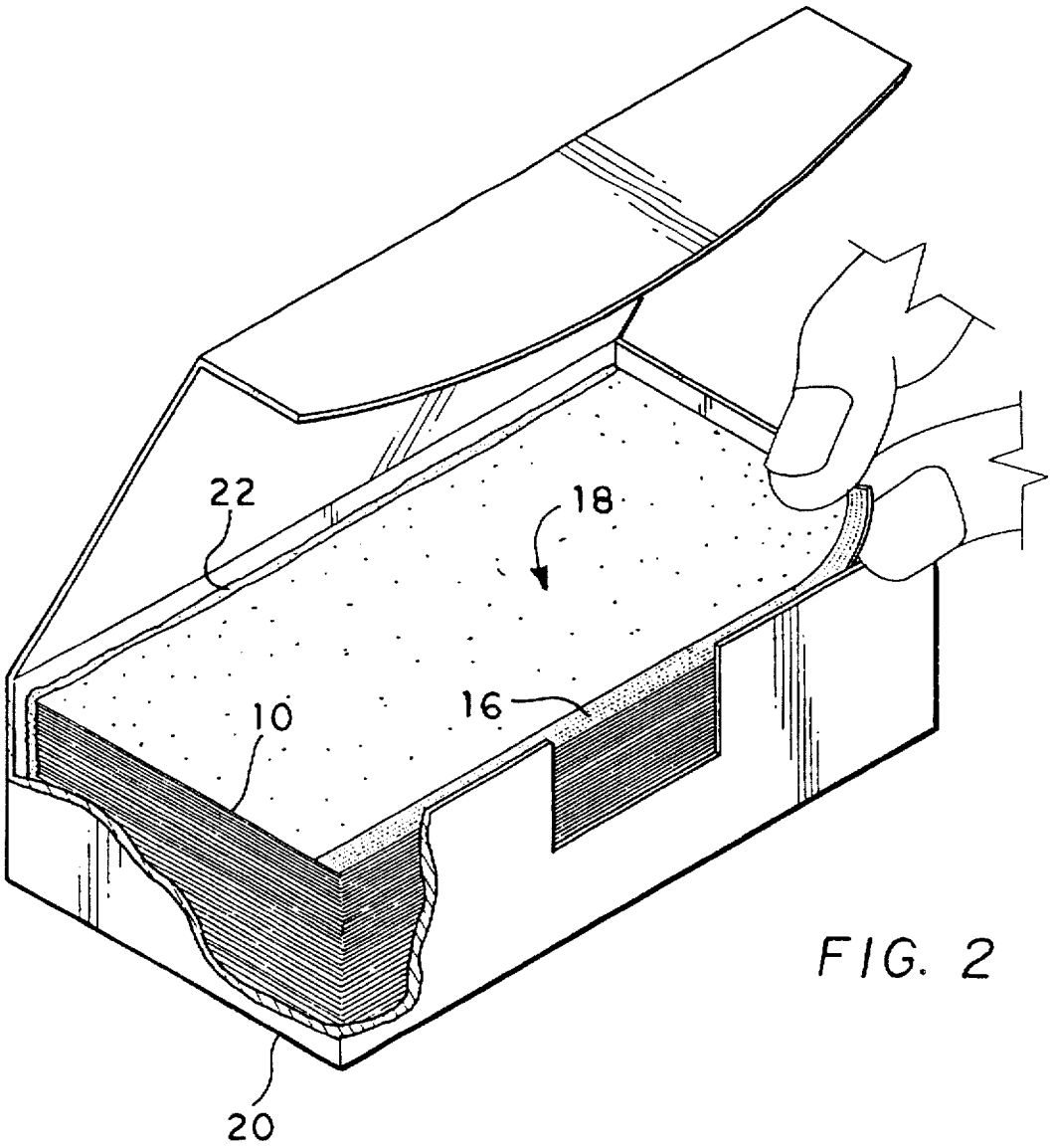
FIG. 2 is a perspective view of a plurality of reconstituted tobacco sheets gummed to form a stack of individually removable sheets.

FIG. 2 shows the preferred embodiment as a stack 18 of a predetermined number of sheets 10 and packaged in a suitable container 20. A bound pack 18 is shown, provided with a tearable adhesive 22 applied to one side of the stack formed by the contiguous long edges 12 of the stacked sheets 10, thereby binding each of the plurality of sheets 10 into a pack 18 of singly, individually removable sheets 10. As suggested by FIG. 2, each sheet can be easily peeled back between the fingers and subsequently torn off the edge of the stack, leaving the remaining sheets undisturbed.

However, the sheets may also be stacked and packaged by the loose sheet (not shown). A sheet stack container 20 may be provided for convenient packaging of such stack, the container 20 preferably being a reclosable box, as shown in FIG. 2. However, packaging may be chosen from any packaging found in the prior art. Other desirable qualities in a container may include maintaining proper freshness of the tobacco product; therefore, a container having resealable qualities may be used. Alternatively, the container may be chosen to provide qualities which reduce and simplify packaging and its associated costs. One such suggested and suitable product is cellophane wrap.

Figure 3A:
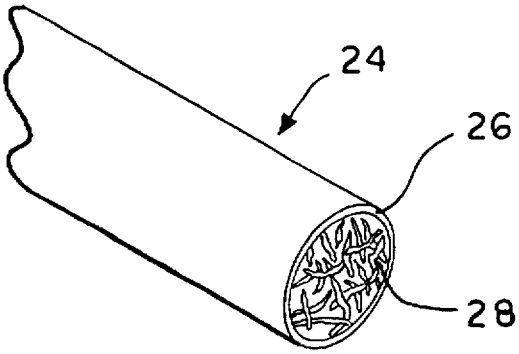
FIG. 3A PRIOR ART
FIG. 3A is a perspective view of a cigarette formed by using shredded tobacco and a paper of the prior art.
Figure 3B:
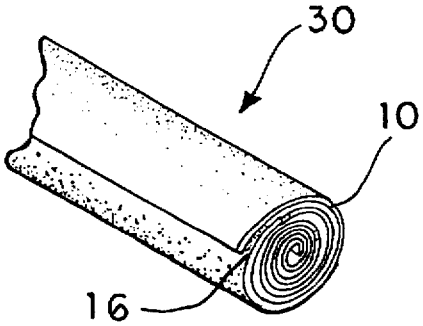
FIG. 3B shows a comparison perspective view of a rolled tobacco product formed from the present invention.

FIG. 3A shows a perspective view of a cigarette 24 rolled from a rolling paper 26 of the type which may be found in the prior art. As is typical, loose cut-leaf tobacco 28 is used to fill the cigarette 24. In comparison, a rolled tobacco product 30 is suggested in FIG. 3B and FIG. 3C formed from a sheet 10 of the present invention. As can be observed in FIG. 3B, the sheet 10 has been spirally rolled such that the tobacco product 30 consists entirely and solely of the sheet 10, without need for added contents. In order to gain a substantial burning time and draw, the paper can be rolled along its long edge; such a use requires that the gum 16 be applied to the sheet 10 along its wide edge 14, rather than its long edge 12.

Figure 3C:
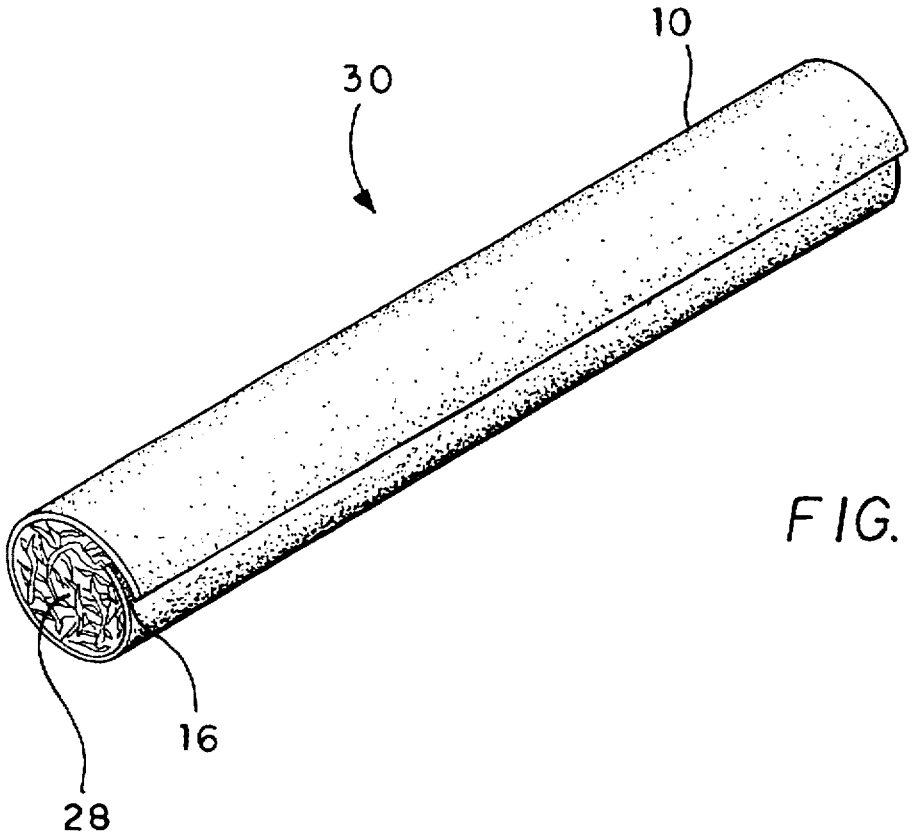
FIG. 3C is a perspective view of a cigarette formed by using shredded tobacco and a sheet of the reconstituted tobacco of the present invention.

FIG. 3C shows the preferred method of use of the sheet 10. The rolled tobacco product 30 is filled with loose cut-leaf tobacco 28 around which the sheet 10 is rolled. The gum 16 is shown extending along the long edge of the sheet 10 so as to provide firm adhesion between the inner and outer surfaces of the sheet 10.

It is to be understood that the present invention is not limited to the embodiments described above, but encompasses any and all embodiments within the scope of the following claims.

I claim:

1. A pack of reconstituted tobacco sheets for rolling tobacco products, comprising:

a plurality of sheets of reconstituted tobacco stacked in a predetermined number to form a paralellepiped stack, each sheet of said plurality of sheets precut to a predetermined rectangular dimension of a standardized width and length, said each sheet having a pair of long edges and a pair of wide edges, said each sheet provided with a gum applied to a predetermined one of said long and wide edges for securing said predetermined one edge to the same said each sheet after being rolled for smoking; and, packaging for enclosing said paralellepiped stack for distribution.

2. The pack according to claim 1, further comprising a tearable adhesive applied to one side of said paralellepiped stack binding said plurality of sheets into a bound pad of individually removable sheets.

3. The pack according to claim 1, wherein said each sheet is a reconstituted tobacco sheet having the smoking aroma and characteristic of cigar tobacco.

4. The pack according to claim 1, wherein said packaging is cellophane wrap wrapped about said paralellepiped stack.

5. The pack according to claim 1, wherein said packaging is a resealable container closely receiving said paralellepiped stack.

6. A pack of reconstituted tobacco sheets for rolling tobacco products comprising:

a plurality of sheets of reconstituted tobacco, each sheet of said plurality of sheets precut to a predetermined rectangular dimension of a standardized width and length, said each sheet having a pair of long edges and a pair of wide edges, said plurality of sheets being stacked in a predetermined number forming a paralellepiped stack;

a tearable adhesive applied to one side of said paralellepiped stack binding each of said plurality of sheets into a bound pack of individually removable sheets; and, packaging for enclosing said paralellepiped stack for distribution.

7. The pack according to claim 6, wherein said packaging is cellophane wrap wrapped about said stack.

8. The pack according to claim 6, wherein said packaging is a resealable container closely receiving said stack.

* * * * *